United States Patent [19]

Volk

[11] 4,271,759

[45] Jun. 9, 1981

[54] PRINTING APPARATUS FOR USE WITH PRICE LABELLER OR THE LIKE

[75] Inventor: Heinrich Volk, Beerfelden, Fed. Rep. of Germany

[73] Assignee: Esselte Pendaflex Corporation, Garden City, N.Y.

[21] Appl. No.: 71,288

[22] Filed: Aug. 30, 1979

[30] Foreign Application Priority Data

Sep. 7, 1978 [DE] Fed. Rep. of Germany ..... 2838964

[51] Int. Cl.[3] ..... B41K 1/10; B41J 1/20

[52] U.S. Cl. ..... 101/110; 101/111

[58] Field of Search ..... 101/110, 111

[56] References Cited

U.S. PATENT DOCUMENTS

| | | | |
|---|---|---|---|
| 660,512 | 10/1906 | Humphrey et al. | 101/110 |
| 2,569,013 | 9/1951 | Lippard | 101/111 |
| 3,744,411 | 7/1973 | Becker | 101/111 |
| 3,968,745 | 7/1976 | Hamisch, Jr. | 101/111 |
| 3,972,281 | 8/1976 | Sams | 101/111 |
| 4,096,800 | 6/1978 | Kistner et al. | 101/111 |
| 4,170,938 | 10/1979 | Sato | 101/111 |

FOREIGN PATENT DOCUMENTS

| | | | |
|---|---|---|---|
| 1929307 | 12/1970 | Fed. Rep. of Germany | 101/111 |
| 2247732 | 1/1974 | Fed. Rep. of Germany | 101/111 |
| 2439523 | 8/1975 | Fed. Rep. of Germany | 101/111 |

*Primary Examiner*—William Pieprz

*Attorney, Agent, or Firm*—Gerald J. Ferguson, Jr.; Joseph J. Baker

[57] ABSTRACT

Printing apparatus comprising a housing having at least two oppositely disposed side walls; a plurality of sets of juxtaposed printing elements; a plurality of internally toothed, annular setting wheels supported with respect to the housing for respectively positioning the printing elements; a hollow, axially shiftable, setting shaft extending at least into the annular setting wheels, the setting shaft including (a) a drive member for engaging the internal teeth of a selected one of the setting wheels and (b) a detenting member; a pin mounted with respect to one of the side walls, the pin extending into the hollow setting shaft and including a plurality of detent recesses longitudinally extending along the surface of the pin, the distance between at least two of the recesses corresponding to the width of at least one of the setting wheels, the detenting member of the setting shaft engaging a selected one of the recesses for axially positioning the setting shaft at the setting wheel to be driven.

17 Claims, 9 Drawing Figures

PRINTING APPARATUS FOR USE WITH PRICE LABELLER OR THE LIKE

BACKGROUND OF THE INVENTION

The invention relates to a printing unit for typical use in a price-labelling device or the like.

In such devices, it is possible for the printing types to be set at will into the printing lines, with the aid of setting wheels and a setting shaft.

In certain known printing devices, each setting wheel has guided around it an endless type band, on the external side of which are arranged printing types and possibly also reading types associated with the printing types, while driving projections are arranged on the inside of the said band and these projections engage in tooth gaps of the setting wheel. It is also known to provide the setting wheels on their circumference with printing types and possibly also reading types, so that the setting wheels simultaneously also form printing type wheels.

It is also known to arrange the detent recesses on the setting shaft. The setting shaft is provided with tangentially encircling grooves corresponding to the number of the setting wheels, which grooves have spacings from one another which correspond to the widths of the setting wheels and in which engages a resilient detent member, which is arranged in a fixed position on the housing of the printing unit and is formed by a ball, which is guided in a bore of the housing and which is under the action of a small helical spring.

This known detent or latching device has the disadvantage that the manufacture thereof is costly and that the fitting thereof is complicated and time-consuming. Furthermore, this printing unit has the disadvantage that, with printing units of equal width but a different arrangement of wider or narrower printing type bands or printing type wheels, it is necessary to have setting shafts which are adapted to the arrangement of the wider or narrower bands or wheels.

These disadvantages are at least partially avoided by other known printing devices. For example, in one known device, the printing type wheels provided with the appropriate types have on their periphery recesses which are engaged by projections or teeth of the setting wheels. So as to produce the axial latching of the setting shaft, the latter has fixed thereon so as to be axially immovable a pointer which engages over the circumference of the setting wheels, the said pointer comprising at its free end a detent member projecting at right-angles to the setting shaft and the said detent engages in the latching recesses of an easily replaceable detent rail. By replacing the said detent rail, the said printing unit is capable of being adapted to the actual arrangement of printing type wheels or printing type bands of different widths.

A disadvantage as regards this printing unit is that the detent member and the detent recesses co-operating therewith are spaced from the setting shaft, so that bending moments have to be transmitted by the pointer. As a consequence, the pointer has to be constructed and guided in a suitable manner for absorbing loads.

In another known device, the detent recesses are formed by bevelled surfaces on the edges, which are arranged on the bosses of the setting wheels. The bevelled edge surfaces of two setting wheels arranged in juxtaposition form an encircling groove, which is engaged by resilient detent members arranged on the setting shaft. This printing unit has the advantage that the setting wheels themselves form tangentially encircling grooves, of which the axial spacings correspond to the respective widths of the setting wheels and of the printing type bands which are guided over said wheels. However, this printing unit has the disadvantage that the grooves formed by edge bevelled surfaces can only be of relatively small cross-section and these grooves are interrupted by the internal toothing of the setting wheels, which toothing co-operates with the driver element of the setting shaft. The consequence thereof is that resilient detent members are necessary for "feeling" the grooves, the width of said detent members being narrower than the tooth division of the internal toothing. In order to produce an adequate detent or latching effect, it is necessary with the known printing unit to have at least two resilient detent members on the setting shaft. Because of the small size of the grooves and of the resilient detent or latching members and because of the necessary clearance between the individual setting wheels and between the setting shaft and its sliding movement in one wall of the housing and also between the setting shaft and the setting wheels, on the other hand, only narrow production tolerances are permissible with the known printing unit, if the detent or latching mechanism is to be reliable in operation. It is for these reasons that the manufacture of this known printing mechanism or unit is expensive.

SUMMARY OF THE INVENTION

It is an object of this invention to provide a printing device wherein the detent mechanism for an axially displaceable setting shaft can be easily adapted to the actual widths of the printing type wheels or printing type bands, with which the disadvantages described in respect of the known printing devices are avoided and with which the detent device is constructed so as to be of a robust nature and to show a high degree of reliability in operation.

By simply replacing the pin, which is advantageously made of synthetic plastics material and which is more especially secured in the manner of a press-button in a recess of the housing wall by an outwardly resilient insertion detent member, the detent device of the respective arrangement can be adapted to printing type bands or printing type wheels of different widths. No additional parts are necessary for the detent or latching device. An easy and simple positioning of the driver element in the axial direction is obtained if the detent recesses have axially an undulatory or sinusoidal profile. When the pin is rigidly fixed, the detent recesses have to be formed as tangentially encircling grooves.

In a further development of the invention, it is proposed that the cross-section of the longitudinal recess and the cross-section of the pin are not circular and the pin is held to be rotatable about its longitudinal axis on the housing wall and that they are provided with at least two different rows or series of detent recesses. By simply changing the pin, the printing unit can be fitted in a double, triple or quadruple manner and differently with printing type bands or wheels of different widths.

The possible variants as regards the printing unit can be doubled if the series of detent recesses are arranged asymmetrically in relation to the end bearing surfaces of the pin and if the pin is at will capable of being secured at one or the other end on the housing wall.

Other objects and advantages of this invention will be apparent from a reading of the following specification and claims taken with the drawing.

BRIEF DESCRIPTION OF THE DRAWING

One constructional example of a printing mechanism or unit in accordance with the invention is more fully described in the following description and by reference to the drawings, wherein.

DETAILED DESCRIPTION OF PREFERRED EMBODIMENTS OF THE INVENTION

Figure 1:
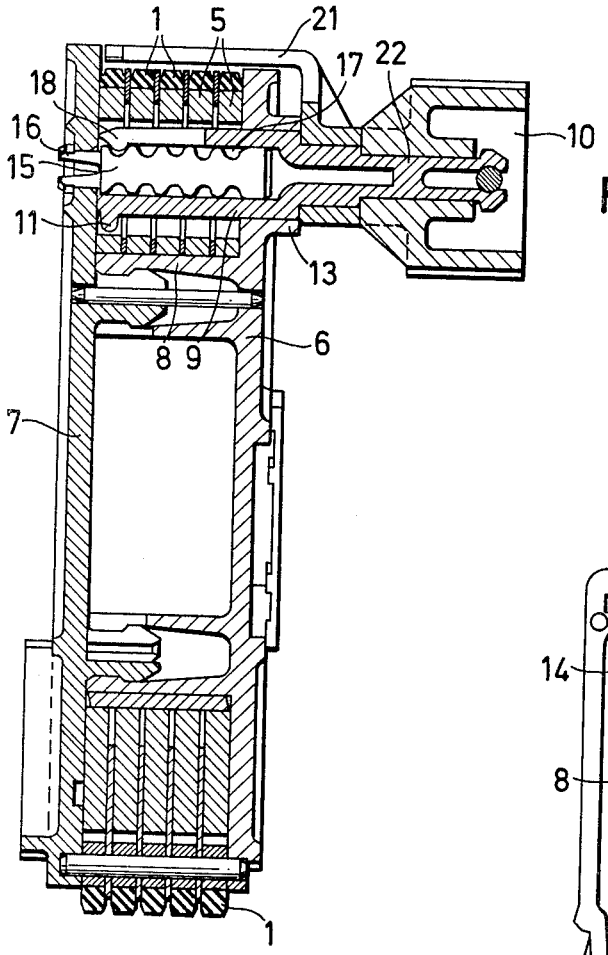
FIG. 1 is a sectional view of the printing unit.

Reference should be made to the drawing where like reference numerals refer to like parts.

Figure 2:
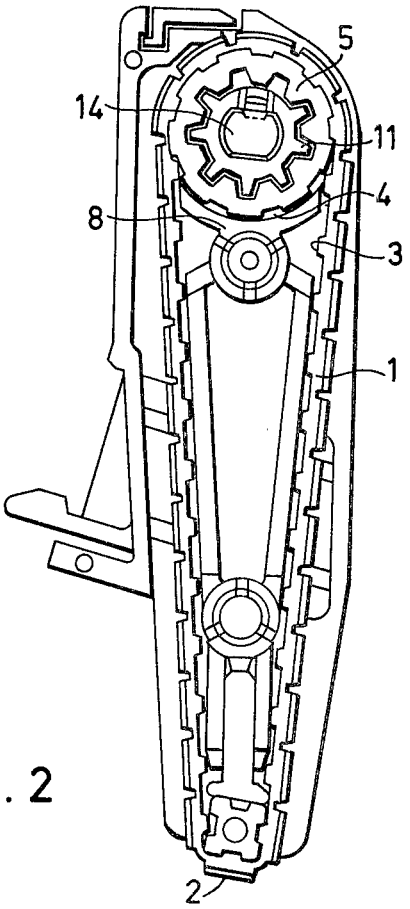
FIG. 2 is a side elevation of the printing unit, with the side wall of the housing removed.

The printing unit according to FIGS. 1 and 2 comprises five type bands 1, which carry printing types 2 on their external surfaces and which comprise driving projections 3 on their internal surfaces. The driving projections 3 engage in tooth gaps 4, which are arranged on the circumference of setting wheels 5. The setting wheels 5 are rotatably mounted between the housing walls 6 and 7 in a trough 8. The printing types 2 can be adjusted by means of a setting shaft 9, which comprises at its outer end a setting knob 10 and which, at its inner, free end, carries a driver element 11 formed as a pinion, which can be brought into mesh with an internal toothing 12 of the setting wheels 5. The setting shaft 9 is arranged to be rotatable and axially displaceable in a plain bearing 13 arranged on the housing wall 6. The setting shaft 9 has a central longitudinal recess 14, in which engages a pin 15, which is held by a push-in or inserted detent or latching member 16 on the housing wall 7. The pin 15 is provided with latching recesses 17, which are arranged at intervals on the pin 15 and which correspond to the spacings of the setting wheels 5 from one another.

Arranged on the free end of the setting shaft 9 is a resilient detent or latch member 18, which is formed by a tongue 19. The tongue 19 is connected in one piece with the setting shaft 9, consisting of synthetic plastics material, and is formed by axially extending notches 20 (see FIG. 3). First of all, a pointer 21 and then setting knob 10 are pushed on to that part of the setting shaft 9 which projects from the housing of the printing unit. The setting shaft 9 is rotatable in relation to the pointer 21, while the setting knob 10 is connected so as to be fast in rotation with the setting shaft 9 by means of the non-circular end region 22.

Figure 3:
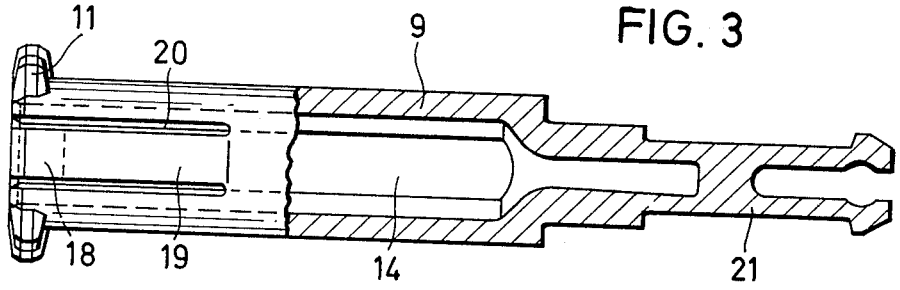
FIG. 3 is a plan view (partly in section) of an illustrative setting shaft for use in the printing unit of FIG. 1.
Figure 4:
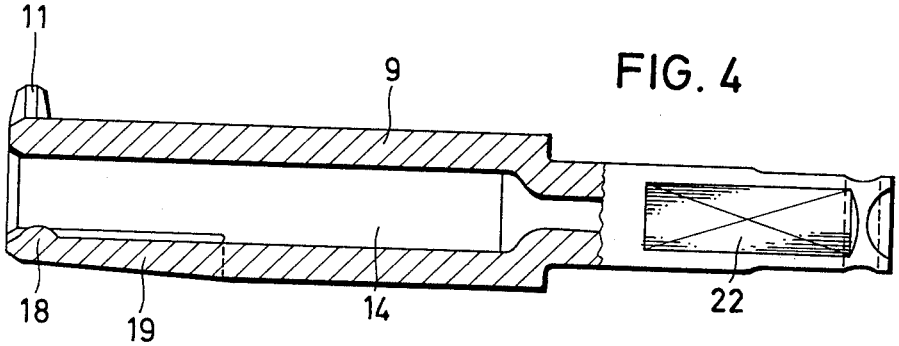
FIG. 4 is a sectional view of the setting shaft.

As shown by FIGS. 3 and 4, the driver element 11 and the resilient detent or latching member 18 are arranged on the free end of the setting shaft 9. The driver element 11 and latch 18 may be arranged in the same plane extending at right-angles to the axis of rotation of the setting shaft 9, or they may also be offset axially to some extent relatively thereto.

Figure 5:
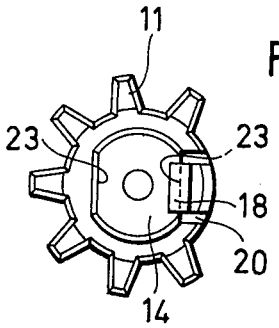
FIG. 5 is a front view of the setting shaft.

As can be seen from FIG. 5, the cross-section of the longitudinal recess 14 has two flattened sides 23. The tongue 19 with the resilient detent or latching member 18 is arranged on one of these flattened sides.

Figure 6:
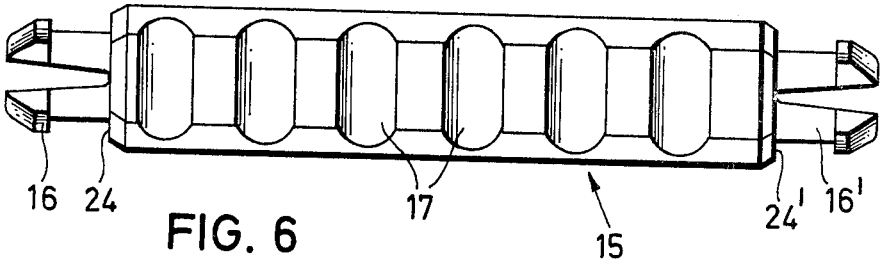
FIG. 6 is a plan view of an illustrative pin for use in the printing unit of FIG. 1.
Figure 7:
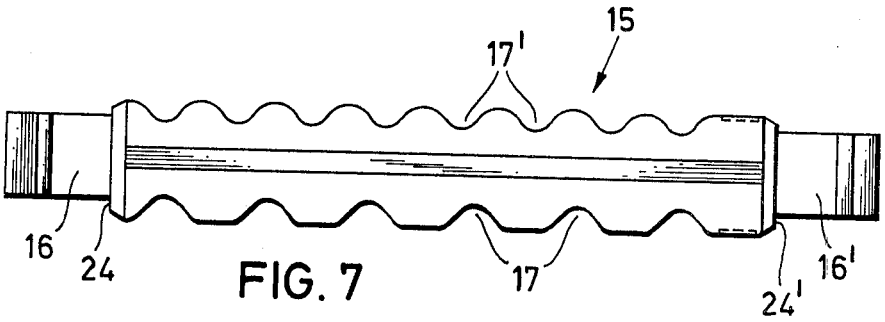
FIG. 7 is a side elevation of the pin.
Figure 8:
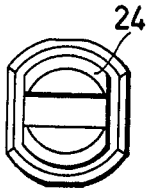
FIG. 8 is a front elevation of the pin.
Figure 9:
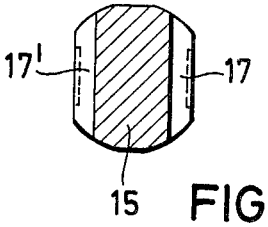
FIG. 9 is a view along the section line IX—IX of FIG. 7.

FIGS. 8 and 9 show that the cross-section of the pin 15 corresponds to the cross-section of the longitudinal recess 14. The pin 15 is thus incapable of being rotated in the longitudinal recess 14. Arranged on the flat sides of the pin 15 are different rows of latching recesses 17 and 17'. If the latch or detent member 18 of the setting shaft 9 co-operates with the latching recesses 17 which can be seen from FIGS. 6 and 7, the printing unit is equipped with six printing type bands 1 and setting wheels 5 of substantially the same width. However, if the detent or latching member 18 of the setting shaft 9 co-operates with the detent recesses 17' which can be seen from FIG. 7, then the printing mechanism or unit is equipped with eight printing type bands 1 and setting wheels 5 of substantially the same width.

Because the printing type bands 1 for certain printing types are narrower than for other printing types, it is also possible for the detent recesses 17, 17' to be arranged at different spacings.

The detent recesses 17, 17' are arranged asymmetrically or axially offset with respect to the end bearing surfaces 24, 24' of the pin 15. Arranged on the two ends of the pin 15 are resilient insertion latches or detent members 16, 16', so that the sequence as regards the different widths of printing types can be changed, if the pin 15 is inserted, rotated through 180°, into the housing wall 6.

It is to be understood that the above detailed description of the various embodiments of the invention is provided by way of example only. Various details of design and construction may be modified without departing from the true spirit and scope of the invention as set forth in the appended claims.

What is claimed is:

1. Printing apparatus comprising a housing having at least two oppositely disposed side walls;

a plurality of sets of juxtaposed printing elements;

a plurality of internally toothed, annular setting wheels supported with respect to said housing for respectively positioning said printing elements;

a hollow, axially shiftable, setting shaft extending at least into said annular setting wheels, said setting shaft including (a) a drive member for engaging the internal teeth of a selected one of said setting wheels and (b) a detenting member; and a pin mounted with respect to one of said side walls, said pin extending into said hollow setting shaft and including two different rows of detent recesses longitudinally extending along two respectively different surfaces of said pin, the distance between at least two of said recesses corresponding to the width of at least one of said setting wheels, said detenting member of the setting shaft engaging a selected one of the recesses for axially positioning the setting shaft at the setting wheel to be driven.

2. Printing apparatus comprising a housing having at least two oppositely disposed side walls;

a plurality of sets of juxtaposed printing elements;

a plurality of internally toothed, annular setting wheels supported with respect to said housing for respectively positioning said printing elements;

a hollow, axially shiftable, setting shaft extending at least into said annular setting wheels, said setting shaft including (a) a drive member for engaging the internal teeth of a selected one of said setting wheels and (b) a detenting member including an inwardly directed, resilient tongue disposed on the setting shaft;

a pin rotatably mounted with respect to one of said side walls, said pin extending into said hollow setting shaft and including two different rows of detent recesses longitudinally extending along two respectively different surfaces of said pin where the internal cross-section of the hollow setting shaft and the external cross-section of said pin are non-circular and correspond to one another so that the pin can not rotate within the setting shaft, the distance between at least two of said recesses corresponding to the width of at least one of said setting wheels, said detenting member of the setting shaft engaging a selected one of the recesses for axially positioning the setting shaft at the setting wheel to be driven; and a hollow bearing member disposed in the side wall opposite said one side wall, said setting shaft being supported in and axially shiftable through said bearing member.

3. Printing apparatus comprising a housing having at least two oppositely disposed side walls;

a plurality of sets of juxtaposed printing elements;

a plurality of internally toothed, annular setting wheels supported with respect to said housing for respectively positioning said printing elements;

a hollow, axially shiftable, setting shaft extending at least into said annular setting wheels, said setting shaft including (a) a drive member for engaging the internal teeth of a selected one of said setting wheels and (b) a detenting member including an inwardly directed, resilient tongue disposed on the setting shaft;

a pin removably mounted with respect to one of said side walls, said pin extending into said hollow setting shaft and including a plurality of detent recesses longitudinally extending along the surface of said pin, the distance between at least two of said recesses corresponding to the width of at least one of said setting wheels, said detenting member of the setting shaft engaging a selected one of the recesses for axially positioning the setting shaft at the setting wheel to be driven; and a hollow bearing member disposed in the side wall opposite said one side wall, said setting shaft being supported in and axially shiftable through said bearing member.

4. Printing apparatus as in claim 3 where (a) the internal cross-section of the hollow setting shaft and the external cross-section of said pin are non-circular and correspond to one another so that the pin can not rotate within the setting shaft, (b) said pin includes at least two different rows of detent recesses respectively disposed on two different surfaces of said pin and (c) said pin includes means for mounting it at one end thereof and also at the other end thereof to said one side wall of the housing.

5. Printing apparatus as in claim 4 where the two rows of detent recesses are asymmetrically disposed with respect to said end and other end of the pin.

6. Printing apparatus comprising a housing having at least two oppositely disposed side walls;

a plurality of sets of juxtaposed printing elements;

a plurality of internally toothed, annular setting wheels supported with respect to said housing for respectively positioning said printing elements;

a hollow, axially shiftable, setting shaft extending at least into said annular setting wheels, said setting shaft including (a) a drive member for engaging the internal teeth of a selected one of said setting wheels and (b) a detenting member; and a pin mounted with respect to one of said side walls, said pin extending into said hollow setting shaft and including a plurality of detent recesses longitudinally extending along the surface of said pin, the distance between at least two of said recesses corresponding to the width of at least one of said setting wheels, said detenting member of the setting shaft engaging a selected one of the recesses for axially positioning the setting shaft at the setting wheel to be driven.

7. Printing apparatus as in claim 6 where said pin is removably mounted on said one side wall.

8. Printing apparatus as in claims 6 or 7 including a hollow bearing member disposed in the side wall opposite said one side wall, said setting shaft being supported in and axially shiftable through said bearing member.

9. Printing apparatus as in claims 6 or 7 where said detenting member comprises an inwardly directed resilient tongue disposed on the setting shaft.

10. Printing apparatus as in claims 7, 2 or 1 where said pin has a substantially oval cross-section with at least two flattened sides and the two different rows of detent recesses are disposed on the two flattened sides respectively.

11. Printing apparatus as in claims 7 or 1 where said pin includes means for mounting it at one end thereof and also at the other end thereof to said one side wall of the housing.

12. Printing apparatus as in claim 11 where the two rows of detent recesses are asymmetrically disposed with respect to said end and other end of the pin.

13. Printing apparatus as in claim 11 where said pin includes at least one radially resilient, detent member disposed at one end of the pin, said radially resilient, detent member being insertable into an opening in said one side wall.

14. Printing apparatus as in claims 6 or 7 where the internal cross-section of the hollow setting shaft and the external cross-section of said pin are non-circular and correspond to one another so that the pin can not rotate within the setting shaft.

15. Printing apparatus as in claim 14 where said cross-sections of the pin and setting shaft are generally oval.

16. Printing apparatus as in claim 14 where said pin is rotatably mounted with respect to said one side wall.

17. Printing apparatus as in claims 7, 13 or 2 where the detent recesses are continuously undulatory in the longitudinal direction of the shaft.

* * * * *